US006601398B2

(12) United States Patent
Singh et al.

(10) Patent No.: US 6,601,398 B2
(45) Date of Patent: Aug. 5, 2003

(54) METHOD AND APPARATUS FOR REFRIGERATION SYSTEM CONTROL HAVING ELECTRONIC EVAPORATOR PRESSURE REGULATORS

(75) Inventors: Abtar Singh, Kennesaw, GA (US); Jim Chabucos, Acworth, GA (US); Paul Wickberg, Marietta, GA (US); John Wallace, Acworth, GA (US)

(73) Assignee: Computer Process Controls, Inc., Kennesaw, GA (US)

( * ) Notice: Subject to any disclaimer, the term of this patent is extended or adjusted under 35 U.S.C. 154(b) by 0 days.

(21) Appl. No.: 10/146,848

(22) Filed: May 16, 2002

(65) Prior Publication Data

US 2002/0174669 A1 Nov. 28, 2002

Related U.S. Application Data

(62) Division of application No. 10/061,703, filed on Feb. 1, 2002, now Pat. No. 6,449,968, which is a division of application No. 09/539,563, filed on Mar. 31, 2000, now Pat. No. 6,360,553.

(51) Int. Cl.[7] ..... F25B 41/04

(52) U.S. Cl. ..... 62/217; 62/228.3

(58) Field of Search ..... 62/228.3, 175, 62/217, 152, 228.1, 228.4, 228.5, 226, 227, 204, 205, 151, 199, 200

(56) References Cited

U.S. PATENT DOCUMENTS

| | | | | |
|---|---|---|---|---|
| 3,564,865 A | | 2/1971 | Spencer et al. | 62/197 |
| 3,698,204 A | | 10/1972 | Schlotterbeck et al. | 62/206 |
| 4,084,388 A | * | 4/1978 | Nelson | 62/152 |
| 4,487,028 A | | 12/1984 | Foye | |
| 4,487,031 A | | 12/1984 | Rogers et al. | |
| 4,679,404 A | | 7/1987 | Alsenz | |
| 4,742,689 A | | 5/1988 | Lowes | |
| 4,789,025 A | | 12/1988 | Brandemuehl et al. | |
| 4,825,662 A | | 5/1989 | Alsenz | |
| 4,875,341 A | | 10/1989 | Brandemuehl et al. | 62/115 |
| 4,951,475 A | * | 8/1990 | Alsenz | 62/175 X |
| 4,962,648 A | | 10/1990 | Takizawa et al. | 62/199 |
| 4,977,751 A | | 12/1990 | Hanson | 62/81 |
| 5,056,328 A | | 10/1991 | Jaster et al. | 62/180 |
| 5,065,591 A | | 11/1991 | Shaw | 62/175 |
| 5,077,982 A | | 1/1992 | Shaffer, Jr. | 62/199 |
| 5,123,255 A | | 6/1992 | Ohizumi | 62/175 |
| 5,163,301 A | | 11/1992 | Cahill-O'Brien et al. | 62/217 |
| 5,182,920 A | | 2/1993 | Matsuoka et al. | 62/206 |
| 5,239,835 A | | 8/1993 | Kitaguchi et al. | 62/217 |
| 5,247,806 A | | 9/1993 | Ebisu et al. | 62/204 |
| 5,265,434 A | | 11/1993 | Alsenz | 62/117 |
| 5,309,730 A | | 5/1994 | Strand et al. | |
| 5,398,519 A | | 3/1995 | Weber et al. | 62/201 |
| 5,440,891 A | | 8/1995 | Hindmon, Jr. et al. | 62/117 |

(List continued on next page.)

*Primary Examiner*—Harry B. Tanner
(74) *Attorney, Agent, or Firm*—Harness, Dickey & Pierce, P.L.C.

(57) ABSTRACT

A method for refrigeration system control according to the invention includes identifying a lead circuit having a lowest temperature set point from a plurality of circuits, wherein each circuit includes at least one refrigeration case. The suction pressure set point for a compressor rack is initialized based upon the identified lead circuit, and a change in suction pressure set point is determined based on measured parameters from the lead circuit. The suction pressure set point is updated based upon the change in suction pressure set point. A first valve position for a first electronic evaporator pressure regulator associated with a first refrigeration circuit is determined based on the determined change in suction pressure set point, which is based upon the measured parameters from the lead circuit. A second valve position for a second electronic evaporation pressure regulator associated with a second refrigeration circuit is based upon a second measured parameter.

16 Claims, 8 Drawing Sheets

U.S. PATENT DOCUMENTS 5,440,894 A 8/1995 Schaeffer et al. ..... 62/203
5,460,008 A 10/1995 Ott et al.
5,533,347 A 7/1996 Ott et al.
5,572,879 A 11/1996 Harrington et al.
5,634,350 A 6/1997 De Medio
5,711,161 A 1/1998 Gustafson
5,743,098 A 4/1998 Behr
5,842,354 A 12/1998 Kawasumi et al. ..... 62/206
5,857,348 A 1/1999 Conry ..... 62/209
5,867,995 A 2/1999 Lewis ..... 62/115
5,907,957 A 6/1999 Lee et al. ..... 62/217
5,983,657 A 11/1999 Murata et al. ..... 62/228.3
6,047,556 A 4/2000 Lifson
6,047,557 A * 4/2000 Pham et al. ..... 62/228.3 X
6,085,533 A 7/2000 Kaido et al. ..... 62/196.2

* cited by examiner

Membership Function for E0

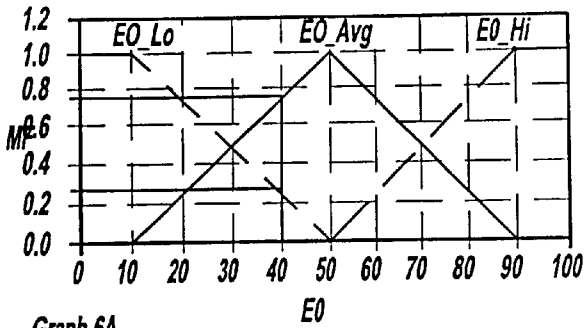

Graph 6A

Membership Function for E1

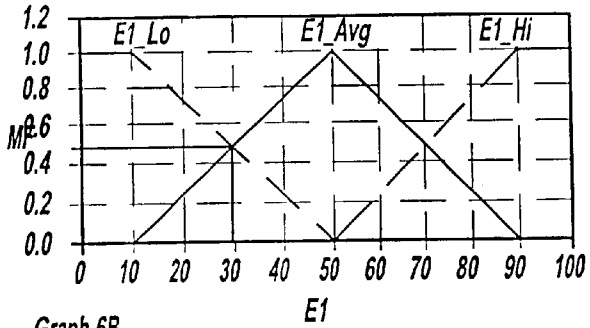

Graph 6B

Note:EO is the percentage of E_ct that is less than zero in 10 minute duration
E1 is the percentage of E_ct that is between zero anf 1 F in 10 minute duration

Figure - 6

TRUTH TABLE 6C

| | E1(J) | 1 | 2 | 3 |
|---|---|---|---|---|
| E0(I) | | Lo | Avg | Hi |
| 1 | Lo | NBC | NSC | NC |
| 2 | Avg. | PSC | PSC | PSC |
| 3 | Hi | PBC | PBC | PBC |

Quantity Changed:

NBC: Negative Big Change=-2 Psi
NSC: Negative Small Change=-1 Psi
NC: No Change=0 Psi
PSC: Positive Small Change=+1 Psi
PBC: Positive Big Change=+2 Psi Sample Calculation: For E0=40%: E1=30%

Step1: Fuzzification:

For E0=40% from Mem. Function Chart for E0 we get E0_Lo=0.25; E0_Avg=0.75
For E1=30% from Mem. Function Chart for E1 we get E1_lo=0.5; E1_Avg=0.5

Step2: MinMax: Refer to Truth Table

E0_Lo=0.25 and E1_Lo=0.5 => NBC=Min(0.25,0.50)=0.25
E0_Lo=0.25 and E1_Avg=0.5 => NBC=Min(0.25,0.50)=0.25
E0_Avg=0.75 and E1_Lo=0.5 => PSC=Min(0.75,0.50)=0.50
E0_Avg=0.75 and E1_Avg=0.5 => PSC=Min(0.75,0.50)=0.50
Now take maximum of common one that is PSC=0.50; NSC=0.25; NBC=0.25

Step3: Defuzzification Step:

Net Pressure set Point Change=+1*PSC-1*NSC-2*NBC/ (PSC+NSC+NBC)
=+1*0.50-1*0.25-2*0.25/ (0.5+0.25+0.25)
=-0.25

Membership Function for VO

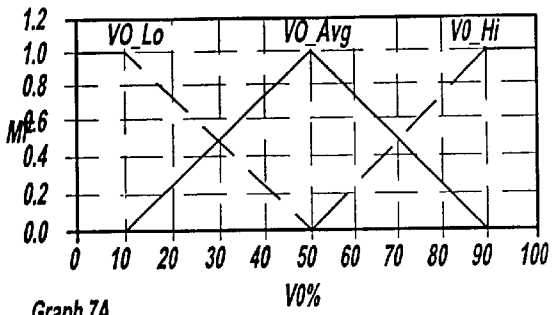

Graph 7A

Membership Function for E1

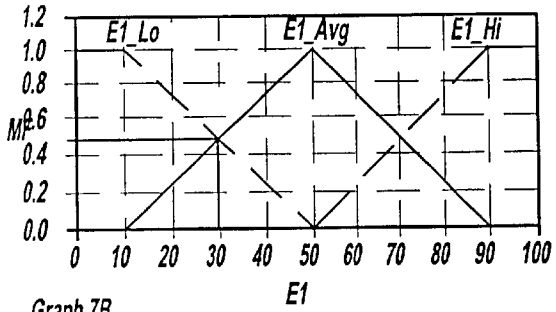

Graph 7B

Note:VO is the percentage of V_ct that is less than 90% valve opening in 10 minute duration
E1 is the percentage of E_ct that is between zero anf 1 F in 10 minute duration

| | TRUTH TABLE 7C | | | |
|---|---|---|---|---|
| | | | | |
| | E1(J) | 1 | 2 | 3 |
| VO(I) | | Lo | Avg | Hi |
| 1 | Lo | PBC | PBC | PBC |
| 2 | Avg. | PSC | PSC | PSC |
| 3 | Hi | NBC | NSC | NC |

Figure - 7

Quantity Changed:

NBC: Negative Big Change=-2 Psi
NSC: Negative Small Change=-1 Psi
NC: No Change=0 Psi
PSC: Positive Small Change=+1 Psi
PBC: Positive Big Change=+2 Psi

METHOD AND APPARATUS FOR REFRIGERATION SYSTEM CONTROL HAVING ELECTRONIC EVAPORATOR PRESSURE REGULATORS

CROSS-REFERENCE TO RELATED APPLICATIONS

This application is a divisional of U.S. patent application Ser. No. 10/061,703 filed on Feb. 1, 2002 U.S. Pat. No. 6,449,968, which is a divisional of U.S. patent application Ser. No. 09/539,563 filed on Mar. 31, 2000, U.S. Pat. No. 6,360,553 which are hereby incorporated by reference.

FIELD OF THE INVENTION

The present invention relates to a method and apparatus for refrigeration system control and, more particularly, to a method and apparatus for refrigeration system control utilizing electronic evaporator pressure regulators and a floating suction pressure set point at a compressor rack.

BACKGROUND OF THE INVENTION

A conventional refrigeration system includes a compressor that compresses refrigerant vapor. The refrigerant vapor from the compressor is directed into a condenser coil where the vapor is liquefied at high pressure. The high pressure liquid refrigerant is then generally delivered to a receiver tank. The high pressure liquid refrigerant from the receiver tank flows from the receiver tank to an evaporator coil after it is expanded by an expansion valve to a low pressure two-phase refrigerant. As the low pressure two-phase refrigerant flows through the evaporator coil, the refrigerant absorbs heat from the refrigeration case and boils off to a single phase low pressure vapor that finally returns to the compressor where the closed loop refrigeration process repeats itself.

In some systems, the refrigeration system will include multiple compressors connected to multiple circuits where a circuit is defined as a physically plumbed series of cases operating at the same pressure/temperature. For example, in a grocery store, one set of cases within a circuit may be used for frozen food, another set used for meats, while another set is used for dairy. Each circuit having a group of cases will thus operate at different temperatures. These differences in temperature are generally achieved by using mechanical evaporator pressure regulators (EPR) or valves located in series with each circuit. Each mechanical evaporator pressure regulator regulates the pressure for all the cases connected within a given circuit. The pressure at which the evaporator pressure regulator controls the circuit is adjusted once during the system start-up using a mechanical pilot screw adjustment present in the valve. The pressure regulation point is selected based on case temperature requirements and pressure drop between the cases and the rack suction pressure.

The multiple compressors are also piped together using suction and discharge gas headers to form a compressor rack consisting of the multiple compressors in parallel. The suction pressure for the compressor rack is controlled by modulating each of the compressors on and off in a controlled fashion. The suction pressure set point for the rack is generally set to a value that can meet the lowest evaporator circuit requirement. In other words, the circuit that operates at the lowest temperature generally controls the suction pressure set point which is fixed to support this circuit.

There are, however, various disadvantages of running and controlling a system in this manner. For example, one disadvantage is that the requirement for the case temperature generally changes throughout the year. This requires a refrigeration mechanic to perform an in-situ change of evaporator pressure settings, via the pilot screw adjustment of each evaporator pressure regulator, thereby further requiring re-adjustment of the fixed suction pressure set point at the rack of compressors. Another disadvantage of this type of control system is that case loads change from winter to summer. Thus, in the winter, there is a lower case load which requires a higher suction pressure set point and in the summer there is a higher load requiring a lower suction pressure set point. However, in the real world, such adjustments are seldom done since they also require manual adjustment by way of a refrigeration mechanic.

What is needed then is a method and apparatus for refrigeration system control which utilizes electronic evaporator pressure regulators and a floating suction pressure set point for the rack of compressors which does not suffer from the above mentioned disadvantages. This, in turn, will provide adaptive adjustment of the evaporator pressure for each circuit, adaptive adjustment of the rack suction pressure, enable changing evaporator pressure requirements remotely, enable adaptive changes in pressure settings for each circuit throughout its operation so that the rack suction pressure is operated at its highest possible value, enable floating circuit temperature based on a product simulator probe, and enable the use of case temperature information to control the evaporator pressure for the whole circuit and the suction pressure at the compressor rack. It is, therefore, an object of the present invention to provide such a method and apparatus for refrigeration system control using electronic evaporator pressure regulators and a floating suction pressure set point.

SUMMARY OF THE INVENTION

In accordance with the teachings of the present invention, a method and apparatus for refrigeration system control utilizing electronic evaporator pressure regulators and a floating suction pressure set point is disclosed. To achieve the above objects of the present invention, the present method and apparatus employs electronic stepper regulators (ESR) instead of mechanical evaporator pressure regulators. The method and apparatus may also utilize temperature display modules at each case that can be configured to collect case temperature, product temperature and other temperatures. The display modules are daisy-chained together to form a communication network with a master controller that controls the electric stepper regulators and the suction pressure set point. The communication network utilized can either be a RS-485 or other protocol, such as LonWorks from Echelon.

In this regard, the data is transferred to the master controller where the data is logged, analyzed and control decisions for the ESR valve position and suction pressure set points are made. The master controller collects the case temperature for all the cases in a given circuit, takes average/min/max (based on user configuration) and applies PI/PID/Fuzzy Logic algorithms to decide the ESR valve position for each circuit. Alternatively, the master controller may collect liquid sub-cooling or relative humidity information to control the ESR valve position for each circuit. The master controller also controls the suction pressure set point for the rack which is adaptively changed, such that the set point is adjusted in such a way that at least one ESR valve is always kept substantially 100% open.

In one preferred embodiment, an apparatus for refrigeration system control includes a plurality of circuits with each of the circuits having at least one refrigeration case. An electronic evaporator pressure regulator is in communication with each circuit with each electronic evaporator pressure regulator operable to control the temperature of each circuit. A sensor is in communication with each circuit and is operable to measure a parameter from each circuit. A plurality of compressors is also provided with each compressor forming a part of a compressor rack. A controller controls each evaporator pressure regulator and a suction pressure of the compressor rack based upon the measured parameters from each of the circuits.

In another preferred embodiment, a method for refrigeration system control is set forth. This method includes measuring a first parameter from a first circuit where the first circuit includes at least one refrigeration case, measuring a second parameter from a second circuit where the second circuit includes at least one refrigeration case, determining a first valve position for a first electronic evaporator pressure regulator associated with the first circuit based upon the first parameter, determining a second valve position for a second electronic evaporator pressure regulator associated with the second circuit based upon the second parameter, electronically controlling the first and the second evaporator pressure regulators to control the temperature in the first circuit and the second circuit.

In another preferred embodiment, a method for refrigeration system control is set forth. This method includes a lead circuit having a lowest temperature set point from a plurality of circuits where each circuit has at least one refrigeration case, initializing a suction pressure set point for a compressor rack having at least one compressor based upon the identified lead circuit, determining a change in suction pressure set point based upon measured parameters from the lead circuit and updating the suction pressure based upon the change in suction pressure set point.

In yet another preferred embodiment, a method for refrigeration system control is also set forth. This method includes setting a maximum allowable product temperature for a circuit having at least one refrigeration case, determining a product simulated temperature for the circuit, calculating the difference between the product simulated temperature and the maximum allowable product temperature, and adjusting the temperature set point of the circuit based upon the calculated difference.

Use of the present invention provides a method and apparatus for refrigeration system control. As a result, the aforementioned disadvantages associated with the currently available refrigeration control systems have been substantially reduced or eliminated.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 6 is an illustration of the fuzzy logic utilized in methods 1 and 2 of FIG. 5;

FIG. 7 is an illustration of the fuzzy logic utilized in method 3 of FIG. 5.

DETAILED DESCRIPTION OF THE PREFERRED EMBODIMENTS

The following description of the preferred embodiment(s) is merely exemplary in nature and is in no way intended to limit the invention, its application, or uses.

Figure 1:
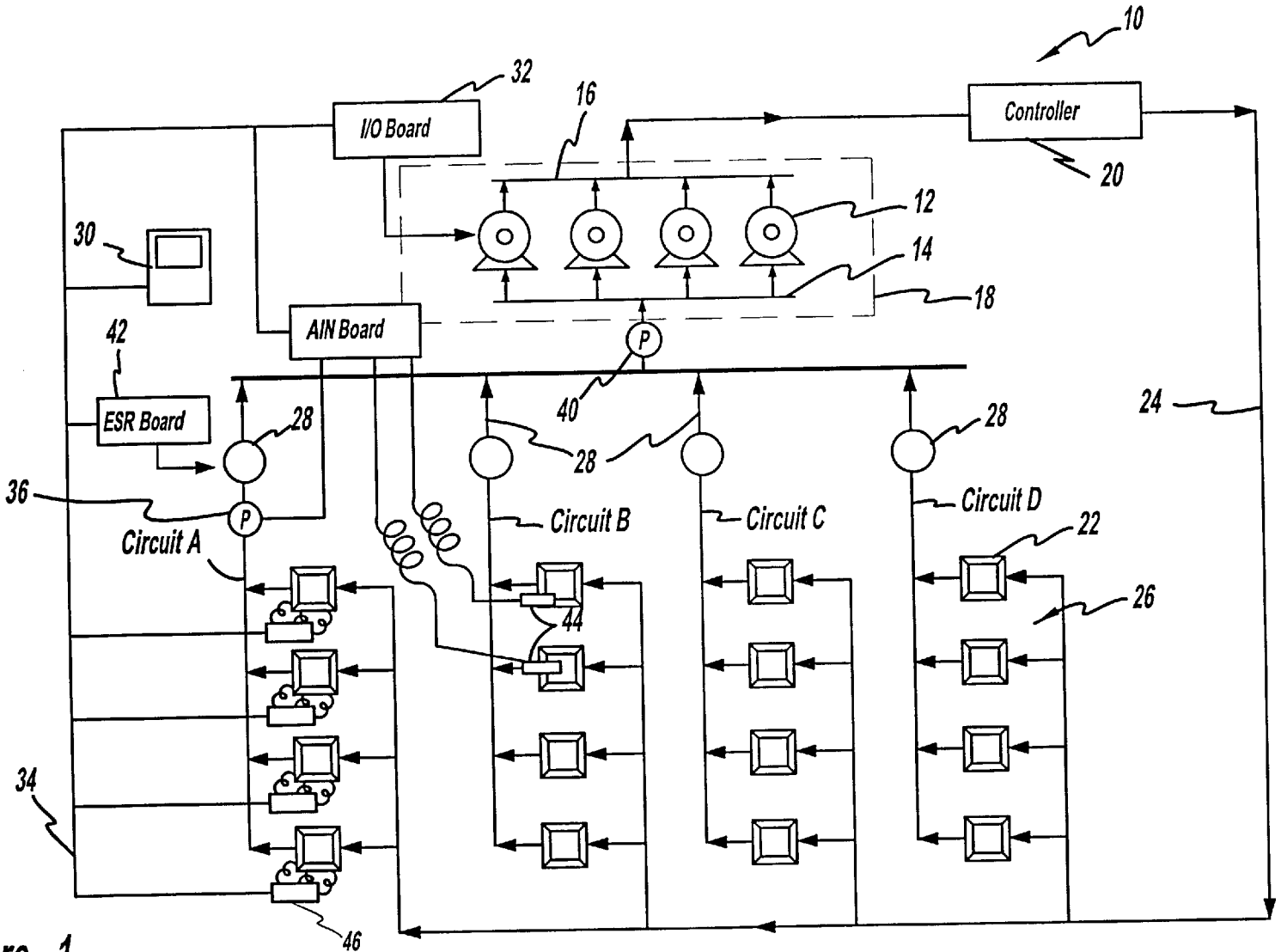
FIG. 1 is a block diagram of a refrigeration system employing a method and apparatus for refrigeration system control according to the teachings of the preferred embodiment in the present invention.

Referring to FIG. 1, a detailed block diagram of a refrigeration system 10 according to the teachings of the preferred embodiment in the present invention is shown. The refrigeration system 10 includes a plurality of compressors 12 piped together with a common suction manifold 14 and a discharge header 16 all positioned within a compressor rack 18. The compressor rack 18 compresses refrigerant vapor which is delivered to a condenser 20 where the refrigerant vapor is liquefied at high pressure. This high pressure liquid refrigerant is delivered to a plurality of refrigeration cases 22 by way of piping 24. Each refrigeration case 22 is arranged in separate circuits 26 consisting of a plurality of refrigeration cases 22 which operate within a same temperature range. FIG. 1 illustrates four (4) circuits 26 labeled circuit A, circuit B, circuit C and circuit D. Each circuit 26 is shown consisting of four (4) refrigeration cases 22. However, those skilled in the art will recognize that any number of circuits 26, as well as any number of refrigeration cases 22 may be employed within a circuit 26. As indicated, each circuit 26 will generally operate within a certain temperature range. For example, circuit A may be for frozen food, circuit B may be for dairy, circuit C may be for meat, etc.

Since the temperature requirement is different for each circuit 26, each circuit 26 includes a pressure regulator 28 which is preferably an electronic stepper regulator (ESR) or valve 28 which acts to control the evaporator pressure and hence, the temperature of the refrigerated space in the refrigeration cases 22. Each refrigeration case 22 also includes its own evaporator and its own expansion valve which may be either a mechanical or an electronic valve for controlling the superheat of the refrigerant. In this regard, refrigerant is delivered by piping 24 to the evaporator in each refrigeration case 22. The refrigerant passes through an expansion valve where a pressure drop occurs to change the high pressure liquid refrigerant to a lower pressure combination of a liquid and a vapor. As the hot air from the refrigeration case 22 moves across the evaporator coil, the low pressure liquid turns into gas. This low pressure gas is delivered to the pressure regulator 28 associated with that particular circuit 26. At the pressure regulator 28, the pressure is dropped as the gas returns to the compressor rack 18. At the compressor rack 18, the low pressure gas is again compressed to a high pressure and delivered to the condenser 20 which again, creates a high pressure liquid to start the refrigeration cycle over.

To control the various functions of the refrigeration system 10, a main refrigeration controller 30 is used and configured or programmed to control the operation of each pressure regulator (ESR) 28, as well as the suction pressure set point for the entire compressor rack 18, further discussed herein. The refrigeration controller 30 is preferably an Einstein Area Controller offered by CPC, Inc. of Atlanta, Ga., or any other type of programmable controller which may be programmed, as discussed herein. The refrigeration controller 30 controls the bank of compressors 12 in the compressor rack 18, via an input/output module 32. The input/output module 32 has relay switches to turn the compressors 12 on an off to provide the desired suction pressure. A separate case controller, such as a CC-100 case controller, also offered by CPC, Inc. of Atlanta, Ga. may be used to control the superheat of the refrigerant to each refrigeration case 22, via an electronic expansion valve in each refrigeration case 22 by way of a communication network or bus 34. Alternatively, a mechanical expansion valve may be used in place of the separate case controller. Should separate case controllers be utilized, the main refrigeration controller 30 may be used to configure each separate case controller, also via the communication bus 34. The communication bus 34 may either be a RS-485 communication bus or a LonWorks Echelon bus which enables the main refrigeration controller 30 and the separate case controllers to receive information from each case 22.

In order to monitor the pressure in each circuit 26, a pressure transducer 36 may be provided at each circuit 26 (see circuit A) and positioned at the output of the bank of refrigeration cases 22 or just prior to the pressure regulator 28. Each pressure transducer 36 delivers an analog signal to an analog input board 38 which measures the analog signal and delivers this information to the main refrigeration controller 30, via the communication bus 34. The analog input board 38 may be a conventional analog input board utilized in the refrigeration control environment. A pressure transducer 40 is also utilized to measure the suction pressure for the compressor rack 18 which is also delivered to the analog input board 38. The pressure transducer 40 enables adaptive control of the suction pressure for the compressor rack 18, further discussed herein. In order to vary the openings in each pressure regulator 28, an electronic stepper regulator (ESR) board 42 is utilized which is capable of driving up to eight (8) electronic stepper regulators 28. The ESR board 42 is preferably an ESR 8 board offered by CPC, Inc. of Atlanta, Ga., which consists of eight (8) drivers capable of driving the stepper valves 28, via control from the main refrigeration controller 30.

As opposed to using a pressure transducer 36 to control a pressure regulator 28, ambient temperature inside the cases 22 may be also be used to control the opening of each pressure regulator 28. In this regard, circuit B is shown having temperature sensors 44 associated with each individual refrigeration case 22. Each refrigeration case 22 in the circuit B may have a separate temperature sensor 44 to take average/min/max temperatures used to control the pressure regulator 28 or a single temperature sensor 44 may be utilized in one refrigeration case 22 within circuit B, since all of the refrigeration cases in a circuit 26 operate at substantially the same temperature range. These temperature inputs are also provided to the analog input board 38 which returns the information to the main refrigeration controller 30, via the communication bus 34.

As opposed to using an individual temperature sensor 44 to determine the temperature for a refrigeration case 22, a temperature display module 46 may alternatively be used, as shown in circuit A. The temperature display module 46 is preferably a TD3 Case Temperature Display, also offered by CPC, Inc. of Atlanta, Ga. The connection of the temperature display 46 is shown in more detail in FIG. 2. In this regard, the display module 46 will be mounted in each refrigeration case 22. Each module 46 is designed to measure up to three (3) temperature signals. These signals include the case discharge air temperature, via discharge temperature sensor 48, the simulated product temperature, via the product simulator temperature probe 50 and a defrost termination temperature, via a defrost termination sensor 52. These sensors may also be interchanged with other sensors, such as return air sensor, evaporator temperature or clean switch sensor. The display module 46 also includes an LED display 54 that can be configured to display any of the temperatures and/or case status (defrost/refrigeration/alarm).

The product simulator temperature probe 50 is preferably the Product Probe, also offered by CPC, Inc. of Atlanta, Ga. The product probe 50 is a 16 oz. container filled with four percent (4%) salt water or with a material that has a thermal property similar to food products. The temperature sensing element is embedded in the center of the whole assembly so that the product probe 50 acts thermally like real food products, such as chicken, meat, etc. The display module 46 will measure the case discharge air temperature, via the discharge temperature sensor 48 and the product simulated temperature, via the product probe temperature sensor 50 and then transmit this data to the main refrigeration controller 30, via the communication bus 34. This information is logged and used for subsequent system control utilizing the novel methods discussed herein.

Figure 2:
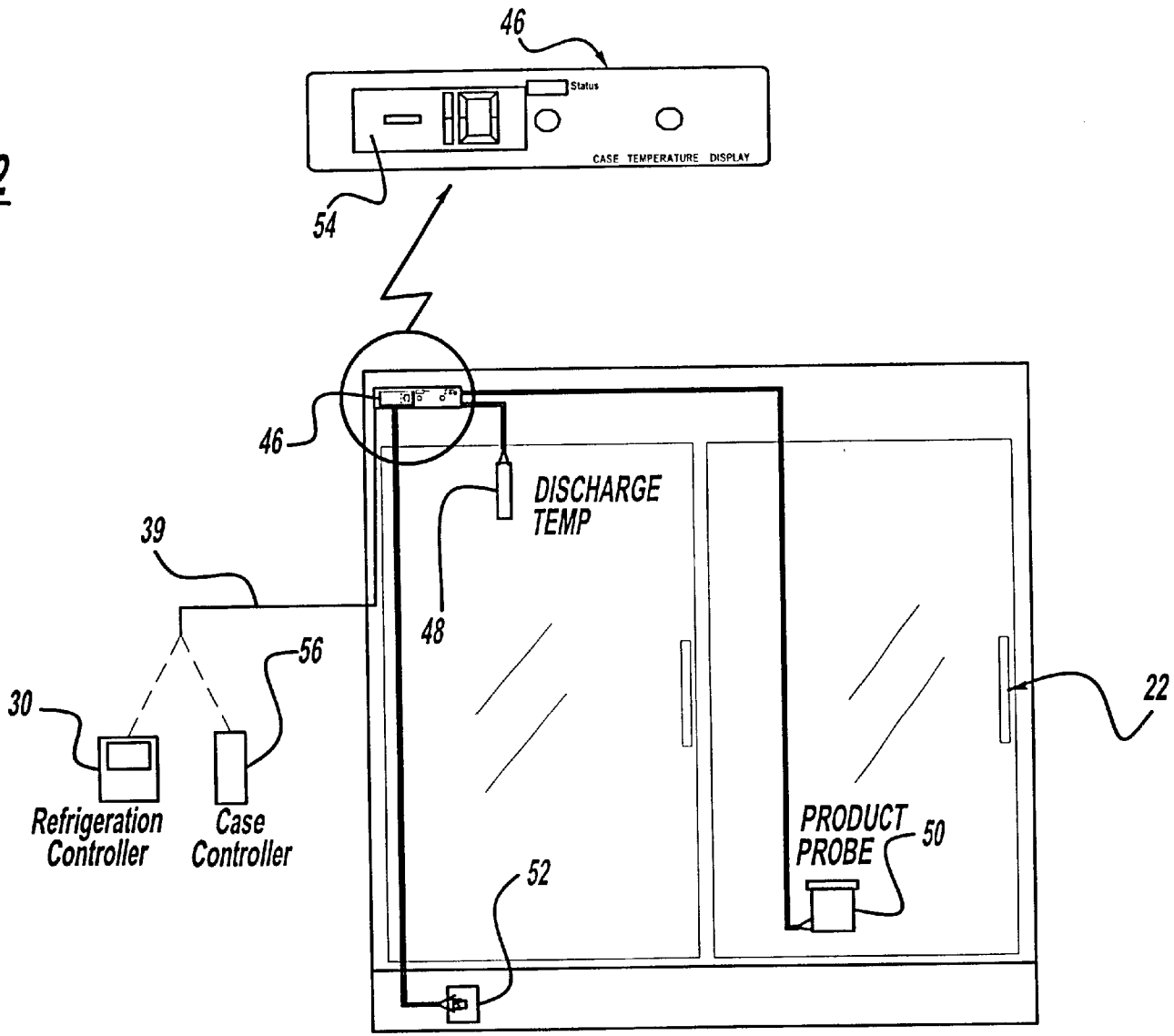
FIG. 2 is a wiring diagram illustrating use of a display module according to the teachings of the preferred embodiment in the present invention.

Alarm limits for each sensor 48, 50 and 52 may also be set at the main refrigeration controller 30, as well as defrosting parameters. The alarm and defrost information can be transmitted from the main refrigeration controller 30 to the display module 46 for displaying the status on the LED display 54. FIG. 2 also shows an alternative configuration for temperature sensing with the display module 46. In this regard, the display module 46 is optionally shown connected to an individual case controller 56, such as the CC-100 Case Controller, offered by CPC, Inc. of Atlanta, Ga. The case controller 56 receives temperature information from the display module 46 to control the electronic expansion valve in the evaporator of the refrigeration case 22, thereby regulating the flow of refrigerant into the evaporator coil and the resultant superheat. This case controller 56 may also control the alarm and defrost operations, as well as send this information back to the display module 46 and/or the refrigeration controller 30.

Briefly, the suction pressure at the compressor rack 18 is dependent in the temperature requirement for each circuit 26. For example, assume circuit A operates at 10° F., circuit B operates at 15° F., circuit C operates at 20° F. and circuit D operates at 25° F. The suction pressure at the compressor rack 18, which is sensed, via the pressure transducer 40, requires a suction pressure set point based on the lowest temperature requirement for all the circuits 26 (i.e., circuit A) or the lead circuit 26. Therefore, the suction pressure at the compressor rack 18 is set to achieve a 10° F. operating temperature for circuit A. This requires the pressure regulator 28 to be substantially opened 100% in circuit A. Thus, if the suction pressure is set for achieving 10° F. at circuit A and no pressure regulator valves 28 were used for each circuit 26, each circuit 26 would operate at the same temperature. However, since each circuit 26 is operating at a different temperature, the electronic stepper regulators or valves 28 are closed a certain percentage for each circuit 26 to control the corresponding temperature for that particular circuit 26. To raise the temperature to 15° F. for circuit B, the stepper regulator valve 28 in circuit B is closed slightly, the valve 28 in circuit C is closed further, and the valve 28 in circuit D is closed even further providing for the various required temperatures.

Each electronic pressure regulator (ESR) 28 may be controlled in one of three (3) ways. Specifically, each pressure regulator 28 may be controlled based upon pressure readings from the pressure transducer 36, based upon temperature readings, via the temperature sensor 44, or based upon multiple temperature readings taken through the display module 46.

Figure 3:
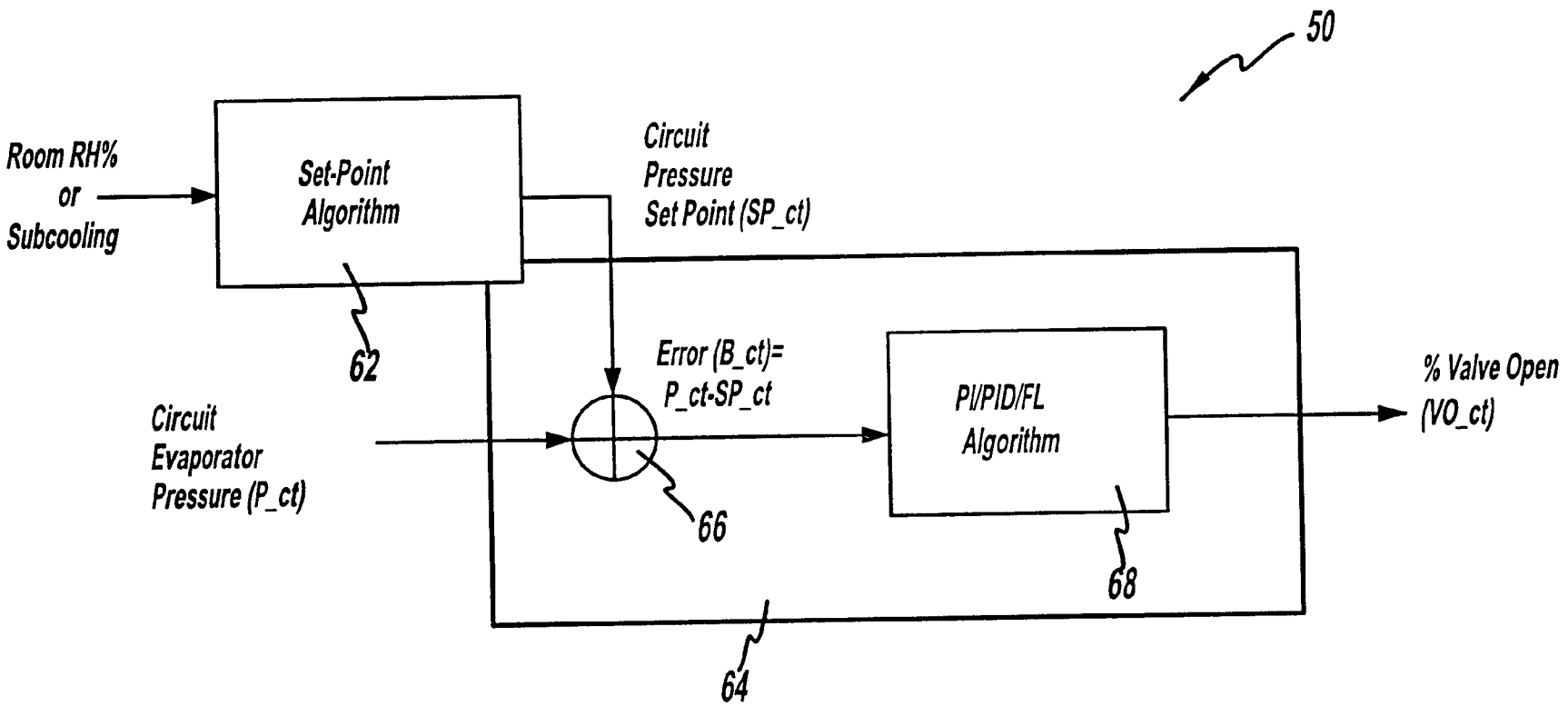
FIG. 3 is a flow chart illustrating circuit pressure control using an electronic pressure regulator.

Referring to FIG. 3, a pressure control logic 60 is shown which controls the electronic pressure regulators (ESR) 28. In this regard, the electronic pressure regulators 28 are controlled by measuring the pressure of a particular circuit 26 by way of the pressure transducer 36. As shown in FIG. 1, circuit A includes a pressure transducer 36 which is coupled to the analog input board 38. The analog input board 38 measures the evaporator pressure and transmits the data to the refrigeration controller 30 using the communication network 34. The pressure control logic or algorithm 60 is programmed into the refrigeration controller 30.

The pressure control logic 60 includes a set point algorithm 62. The set point algorithm 62 is used to adaptively change the desired circuit pressure set point value (SP_ct) for the particular circuit 26 being analyzed based on the level of liquid sub-cooling after the condenser 20 or based on relative humidity (RH) inside the store. The sub-cooling value is the amount of cooling in the liquid refrigerant out of the condenser 20 that is more than the boiling point of the liquid refrigerant. For example, assuming the liquid is water which boils at 212° F. and the temperature out of the condenser is 55° F., the difference between 212° F. and 55° F. is the sub-cooling value (i.e., sub-cooling equals difference between boiling point and liquid temperature). In use, a user will simply select a desired circuit pressure set point value (SP_ct) based on the desired temperature within the particular circuit 26 and the type of refrigerant used from known temperature look-up tables or charts. The set point algorithm 62 will adaptively vary this set point based on the level of liquid sub-cooling after the condenser 20 or based on the relative humidity (RH) inside the store. In this regard, if the circuit pressure set point (SP_ct) for a circuit 26 is chosen to be 30 psig for summer conditions at 80% RH, and 10° F. liquid refrigerant sub-cooling, then for 20% RH or 50° F. sub-cooling, the circuit pressure set point (SP_ct) will be adaptively changed to 33 psig. For other relative humidity (RH %) percentages or other liquid sub-cooling, the values can simply be interpolated from above to determine the corresponding circuit pressure set point (SP_ct). The resulting adaptive circuit pressure set point (SP_ct) is then forwarded to a valve opening control 64.

The valve opening control 64 includes an error detector 66 and a PI/PID/Fuzzy Logic algorithm 68. The error detector 66 receives the circuit evaporator pressure (P_ct) which is measured by way of the pressure transducer 36 located at the output of the circuit 26. The error detector 26 also receives the adaptive circuit pressure set point (SP_ct) from the set point algorithm 62 to determine the difference or error (E_ct) between the circuit evaporator pressure (P_ct) and the desired circuit pressure set point (SP_ct). This error (E_ct) is applied to the PI/PID/Fuzzy Logic algorithm 68. The PI/PID/Fuzzy Logic algorithm 68 may be any conventional refrigeration control algorithm that can receive an error value and determine a percent (%) valve opening (VO_ct) value for the electronic evaporator pressure regulator 28. It should be noted that in the winter, there is a lower load which therefore requires a higher circuit pressure set point (SP_ct), while in the summer there is a higher load requiring a lower circuit pressure set point (SP_ct). The valve opening (VO_ct) is then used by the refrigeration controller 30 to control the electronic pressure regulator (ESR) 28 for the particular circuit 26 being analyzed via the ESR board 42 and the communication bus 34.

Figure 4:
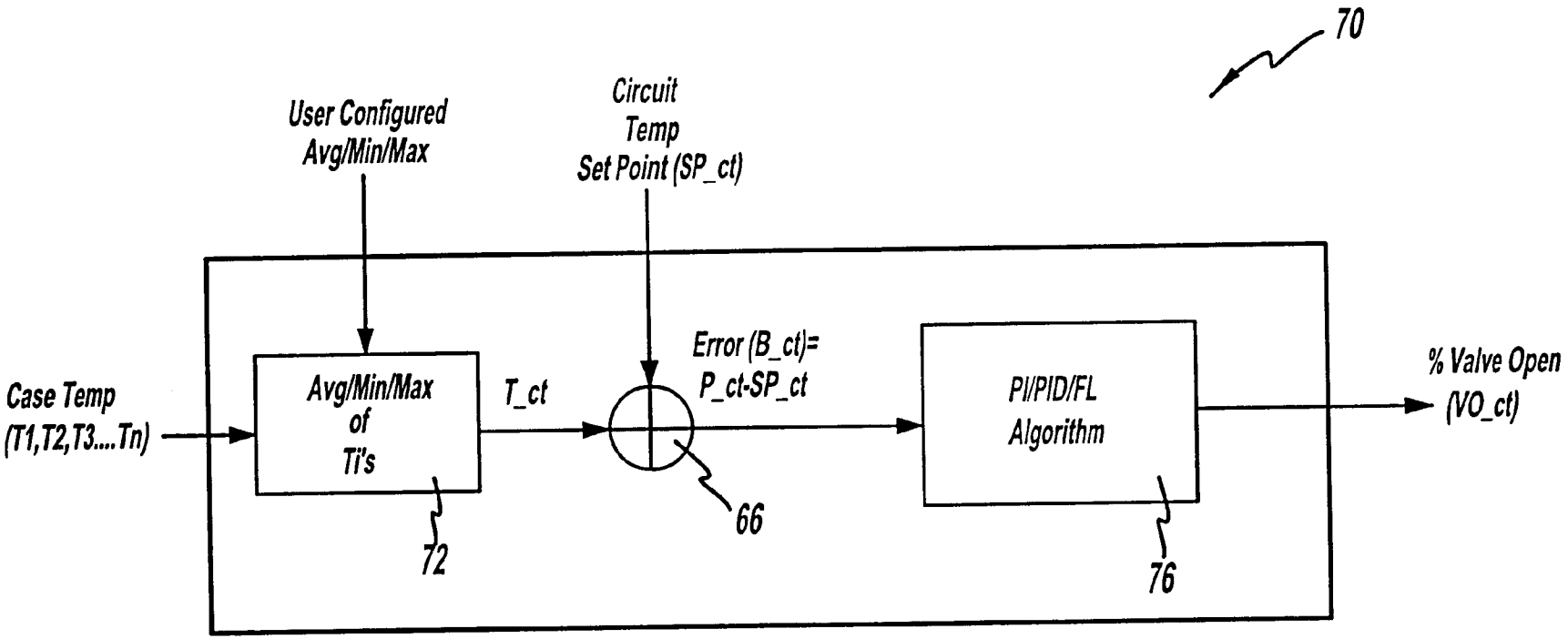
FIG. 4 is a flow chart illustrating circuit temperature control using an electronic pressure regulator.

Referring to FIG. 4, a temperature control logic 70 is shown which may be used in place of the pressure control logic 60 to control the electronic pressure regulator (ESR) 28 for the particular circuit 26 being analyzed. In this regard, each electronic pressure regulator 28 is controlled by measuring the case temperature with respect to the particular circuit 26. As shown in FIG. 1, circuit B includes case temperature sensors 44 which are coupled to the analog input board 38. The analog input board 38 measures the case temperature and transmits the data to the refrigeration controller 30 using the communication network 34. The temperature control logic or algorithm 70 is programmed into the refrigeration controller 30.

The temperature control logic 70 may either receive case temperatures ($T_1$, $T_2$, $T_3$, . . . . $T_n$) from each case 22 in the particular circuit 26 or a single temperature from one case 22 in the circuit 26. Should multiple temperatures be monitored, these temperatures ($T_1$, $T_2$, $T_3$, . . . $T_n$) are manipulated by an average/min/max temperature block 72. Block 72 can either be configured to take the average of each of the temperatures ($T_1$, $T_2$, $T_3$ . . . $T_n$) received from each of the cases 22. Alternatively, the average/min/max temperature block 72 may be configured to monitor the minimum and maximum temperatures from the cases 22 to select a mean value to be utilized or some other appropriate value. Selection of which option to use will generally be determined based upon the type of hardware utilized in the refrigeration control system 10. From block 72, the temperature (T_ct) is applied to an error detector 74. The error detector 74 compares the desired circuit temperature set point (SP_ct) which is set by the user in the refrigeration controller 30 to the actual measured temperature (T_ct) to provide an error value (E_ct). Here again, this error value (E_ct) is applied to a PI/PID/Fuzzy Logic algorithm 76, which is a conventional refrigeration control algorithm, to determine a particular percent (%) valve opening (VO_ct) for the particular electronic pressure regulator (ESR) 28 being controlled via the ESR board 42.

While the temperature control logic 70 is efficient to implement, it has inherent logistic disadvantages. For example, each case temperature sensor 44 requires connecting from each display case 22 to a motor room where the analog input board 38 is generally located. This creates a lot of wiring and installation costs. Therefore, an alternative to this configuration is to utilize the display module 46, as shown in circuit A of FIG. 1. In this regard, a temperature sensor within each case 22 passes the temperature information to the display module 46 which is daisy-chained to the communication network 34. This way, the discharge air temperature sensor 48 or the product probe 50 may be used to determine the case temperature ($T_1$, $T_2$, $T_3$, . . . $T_n$). This information can then be transferred directly from the display module 46 to the refrigeration controller 30 without the need for the analog input board 38, thereby substantially reducing wiring and installation costs.

Figure 5:
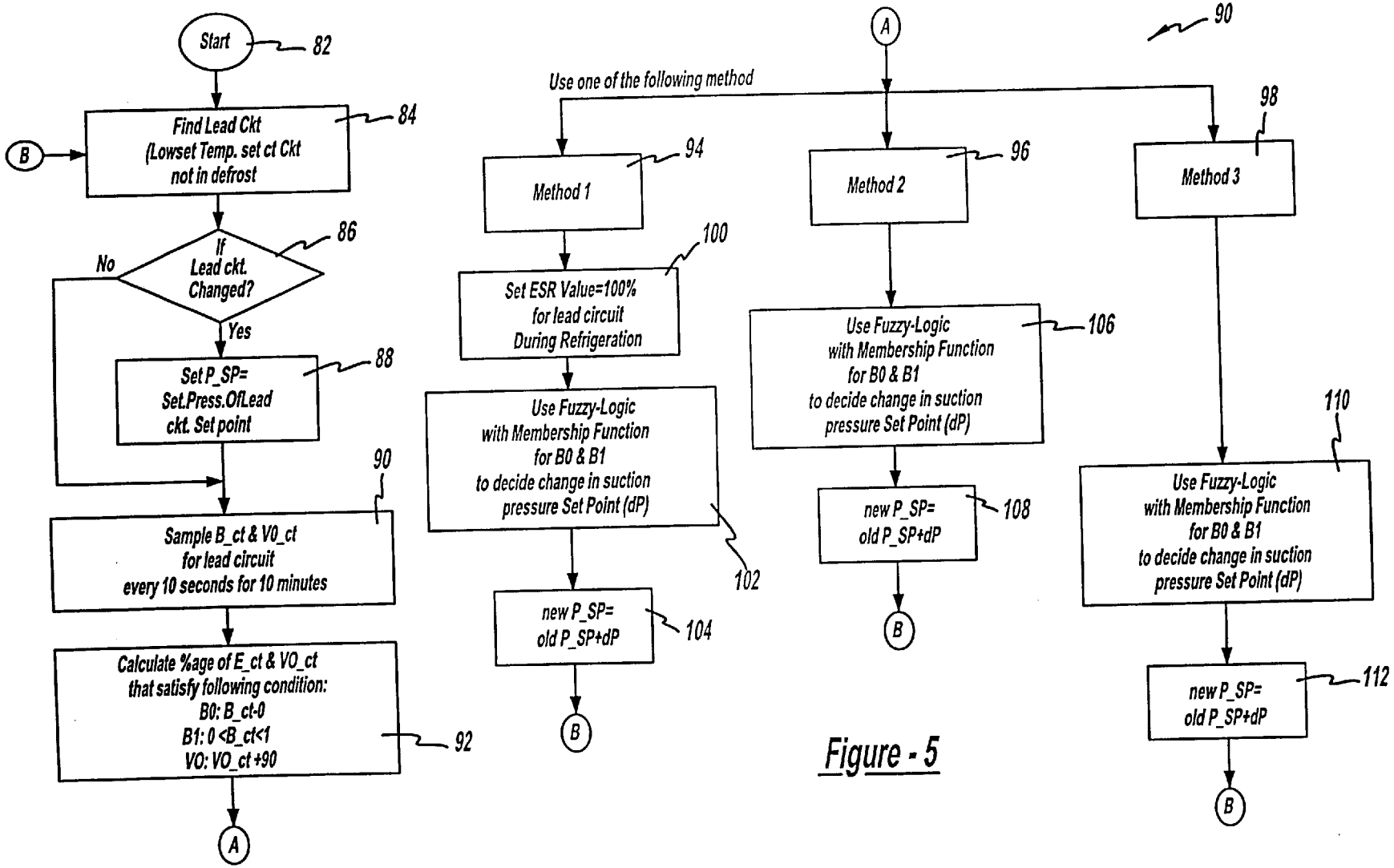
FIG. 5 is an adaptive flow chart to float the rack suction pressure set point according to the teachings of the preferred embodiment of the present invention.

An adaptive suction pressure control logic 80 to control the rack suction pressure set point (P_SP) is shown in FIG. 5. In contrast, the suction pressure set point for a conventional rack is generally manually configured and fixed to a minimum of all the set points used for circuit pressure control. In other words, assume circuit A operates at 0° F., circuit B operates at 5° F., circuit C operates at 10° F. and circuit D operates at 20° F. A user would generally determine the required suction pressure set point based upon pressure/temperature tables and the lowest temperature circuit 26 (i.e., circuit A). In this example, for circuit A operating at 0° F., this would generally require a suction of 30 psig with R404A refrigerant. Therefore, pressure at the suction header 14 would be fixed slightly lower than 30 psig to support each of the circuits A–D. However, according to the teachings of the present invention, the suction pressure set point (P_SP) is not only chosen automatically but also it adaptively changed or floated during the regular control. FIG. 5 illustrates the adaptive suction pressure control logic 80 to control the rack suction pressure set point according to the teachings of the present invention. This suction pressure set point control logic 80 is also generally programmed into the refrigeration controller 30 which adaptively changes the suction pressure, via turning the various compressors 12 on and off in the compressor rack 18. The primary purpose of this adaptive suction pressure control logic 80 is to change the suction pressure set point in such a way that at least one electronic pressure regulator (ESR) 28 is substantially 100% open.

The suction pressure set point control logic 80 begins at start block 82. From start block 82, the adaptive control logic 80 proceeds to locator block 84 which locates or identifies the lead circuit 26 based upon the lowest temperature set point circuit that is not in defrost. In other words, should circuit A be operating at −10° F., circuit B should be operating at 0° F., circuit C would be operating at 5° F. and circuit D would be operating at 10° F., circuit A would be identified as the lead circuit 26 in block 84. From block 84, the control logic 80 proceeds to decision block 86. At decision block 86, a determination is made whether or not the lead circuit 26 has changed from the previous lead circuit 26. In this regard, upon initial start-up of the control logic 80, the lead circuit 26 selected in block 84 which is not in defrost will be a new lead circuit 26, therefore following the yes branch of decision block 86 to initialization block 88.

At initialization block 88, the suction pressure set point P_SP for the lead circuit 26 is determined which is the saturation pressure of the lead circuit set point. For example, the initialized suction pressure set point (P_SP) is based upon the minimum set point from each of the circuits A–D (SP_ct1, SP_ct2, . . . SP_ctN) or the lead circuit 26. Accordingly, if the electronic pressure regulators 28 are controlled based upon pressure, as set forth in FIG. 3, the known required circuit pressure set point (SP_ct) is selected from the lead circuit (i.e., circuit A) for this initialized suction pressure set point (P_SP). If the electronic pressure regulators 28 are controlled based on temperature, as set forth in FIG. 4, then pressure-temperature look-up tables or charts are used by the control logic 80 to convert the minimum circuit temperature set point (SP_ct) of the lead circuit 26 to the initialized suction pressure set point (P_SP). For example, for circuit A operating at −10°, the control logic 80 would determine the initialized suction pressure set point (P_SP) based upon pressure-temperature look-up tables or charts for the refrigerant used in the system. Since the suction pressure set point (P_SP) is taken from the lead circuit A, this is essentially a minimum of all the coolant saturation pressures of each of the circuits A–D.

Once the minimum suction pressure set point (P_SP) is initialized in initialization block 88, the adaptive control or algorithm 80 proceeds to sampling block 90. At sampling block 90, the adaptive control logic 80 samples the error value (E_ct) (difference between actual circuit pressure and corresponding circuit pressure set point if pressure based control is performed (see FIG. 3), if temperature based control then E_ct is the difference between actual circuit temperature and corresponding circuit temperature set point (see FIG. 4)) and the valve opening percent (VO_ct) in the lead circuit every 10 seconds for 10 minutes. When the lead circuit A is in defrost, sampling is then performed on the next lead circuit (i.e., next higher temperature set point circuit) further discussed herein. This set of sixty samples of data from the lead circuit A is then used to calculate the percentage of error values (E_ct) and valve openings (VO_ct) that satisfy certain conditions in calculation block 92.

In calculation block 92, the percentage of error values (E_ct) that are less than 0 (E0); the percent of error values (E_ct) which are greater than 0 and less than 1 (E1) and the valve openings (VO_ct) that are greater than ninety percent are determined in calculation block 92, represented by VO as set forth in block 92. For example, assuming the sample block 90 samples the following error data:

| | 1 | 2 | 3 | 4 | 5 | 6 |
|---|---|---|---|---|---|---|
| 1 | +0.5 | [−1.0] | +0.1 | +1.8 | [−1.0] | [−1.0] |
| 2 | +1.0 | [−1.5] | [−1.5] | +2.0 | [−2.0] | 0.1 |
| 3 | +2.0 | [−3.0] | +0.5 | +6.0 | [−2.5] | 0.2 |
| 4 | +3.0 | [−7.0] | [−0.3] | +3.0 | [−2.2] | 0.5 |
| 5 | +1.5 | [−4.0] | +0.4 | +1.5 | [−2.8] | 0.9 |
| 6 | +0.7 | [−2.0] | +0.7 | +0.9 | [−2.3] | 1.2 |
| 7 | +0.2 | [−3.0] | +0.8 | +0.8 | [−5.5] | 1.3 |
| 8 | 0.0 | [−1.5] | +1.1 | +0.1 | [−6.0] | 1.6 |
| 9 | [−0.3] | [−0.5] | +1.7 | [−0.3] | [−4.0] | 1.8 |
| 10 | [−0.8] | [−0.1] | +1.3 | [−0.8] | [−2.0] | 2.0 |

where each column represents a measurement taken every ten seconds with six columns representing a total data set of 60 data points. There are 17 error values (E_ct) that are between 0 and 1 identified above by underlines, providing an E1of 17/60×100%=28.3%. There are also 27 error values (E_ct) that are less than 0, identified above by brackets, providing an EO of 27/60×100%=45%. Likewise, valve opening percentages are determined substantially in the same way based upon valve opening (VO_ct) measurements.

From calculation block 92, the control logic 80 proceeds to either method 1 branch 94, method 2 branch 96, or method 3 branch 98 with each of these methods providing a substantially similar final control result. Methods 1 and 2 utilize E0 and E1 data only, while method 3 utilizes E1 and VO data only. Methods 1 and 3 may be utilized with electronic pressure regulators 28, while method 2 may be used with mechanical pressure regulators. A selection of which method to utilize is therefore generally determined based upon the type of hardware utilized in the refrigeration system 10.

From method 1 branch 94, the control logic 80 proceeds to set block 100 which sets the electronic stepper regulator valve 28 for the lead circuit A at 100% open during refrigeration. Once the electronic stepper regulator valve 28 for circuit A is set at 100% open, the control logic 80 proceeds to fuzzy logic block 102. Fuzzy logic block 102, further discussed in detail, utilizes membership functions for E0 and E1 to determine a change in the suction pressure set point (dP). Once this change in suction pressure set point (dP) is determined based on the fuzzy logic block 102, the control logic 80 proceeds to update block 104. At update block 104, a new suction pressure set point P_SP is determined based upon the change in pressure set point (dP) where new P_SP=old P_SP+dP.

From the update block 104, the control logic 80 returns to locator block 84 which locates or again identifies the lead circuit 26. In this regard, should the current lead circuit A be put into defrost, the next lead circuit from the remaining circuits 26 in the system (circuit B-circuit D) is identified at locator block 84. Here again, decision block 86 will identify that the lead circuit 26 has changed such that initialization block 88 will determine a new suction pressure set point (P_SP) based upon the new lead circuit 26 selected. Should circuit A not be in defrost and the temperatures for each circuit 26 have not been adjusted, the control logic will proceed to sample block 90 from decision block 86 to continue sampling data. In this way, should the lead circuit A be placed in defrost, the next leading circuit 26 will control the rack suction pressure and since this lead circuit 26 will have a temperature that is not as cold as the initial lead temperature, power is conserved based upon this power conserving loop formed by blocks 84, 86 and 88.

Referring to method 2 branch 96, this method also proceeds to a fuzzy logic block 106 which determines the change in suction pressure set point (dP) based on E0 and E1, substantially similar to fuzzy logic block 102. From block 106, the control logic 80 proceeds to update block 108 which updates the suction pressure set point (P_SP) based on the change in suction pressure set point (dP). From update block 108, the control logic 80 returns to locator block 84.

Referring to the method 3 branch 98, this method utilizes fuzzy logic block 110 which determines a change in suction pressure set point (dP) based upon E1 and VO, further discussed herein. From fuzzy logic block 110, the control logic 80 proceeds to update block 112 which again updates the suction pressure set point P_SP=old P_SP+dP. From the update block 112, the control logic 80 returns again to locator block 84. It should be noted that while method 1 branch 94 forces the lead circuit A to 100% open via block 100, method branches 2 and 3 will eventually direct the electronic stepper regulator valve 28 of lead circuit A to substantially 100% open, based upon the controls shown in FIGS. 3 and 4.

Turning to FIG. 6, the fuzzy logic utilized in method 1 branch 94 and method 2 branch 96 for fuzzy logic blocks 102 and 106 is further set forth in detail. In this regard, the membership function for E0 is shown in graph 6A, while the membership function for E1 is shown in graph 6B. Membership function E0 includes an E0_Lo function, an E0_Avg and an E0_Hi function. Likewise, the membership function for E1 also includes an E1_Lo function and E1_Avg function and an E1_Hi function, shown in graph 6B. To determine the change in suction pressure set point (dP), a sample calculation is provided in FIG. 6 for E0=40% and E1=30%.

In step 1, which is the fuzzification step, for E0=40%, we have both an E0_Lo of 0.25 and an E0_Avg of 0.75, as shown in graph 6A. For E1=30%, we have E1_Lo=0.5 and E1_Avg=0.5, as shown in graph 6B. Once the fuzzification step 1 is performed, the calculation proceeds to step 2 which is a min/max step based upon the truth table 6C. In this regard, each combination of the fuzzification step is reviewed in light of the truth table 6C. These combinations include E0_Lo with E1_Lo; E0_Lo with E1_Avg; E0_Avg with E1_Lo; and E0_Avg with E1_Avg. Referring to the Truth Table 6C, E0_Lo and E1_Lo provides for NBC which is a Negative Big Change. E0_Lo and E1_Avg provides NSC which is a Negative Small Change. E0_Avg and E1_Lo provides for PSC or Positive Small Change. E0_Avg and E1_Avg provides for PSC or Positive Small Change. In the minimization step, a minimum of each of these combinations is determined, as shown in Step 2. The maximum is also determined which provides a PSC=0.5; and NSC=0.25 and an NBC=0.25.

From step 2, the sample calculation proceeds to step 3 which is the defuzzification step. In step 3, the net pressure set point change is calculated by using the following formula:

$$\frac{+2(PBC)+1(PSC)+0(NC)-1(NSC)-2(NBC)}{PBC+PSC+NC+NSC+NBC}$$

By inserting the appropriate values for the variables, we obtain a net pressure set point change of −0.25, as shown in step 3 of the defuzzification step which equals dP. This value is then subtracted from the suction pressure set point in the corresponding update blocks 104 or 108.

Correspondingly for method 3 branch 98, the membership function for VO and the membership function for E1 are shown in FIG. 7. Here again, the same three calculations from step 1 (fuzzification); step 2 (min/max) and step 3 (defuzzification) are performed to determine the net pressure set point change dP, based upon the membership function for VO shown in graph 7A, the membership function for E1 shown in graph 7B, and the Truth Table 7C.

Figure 8:
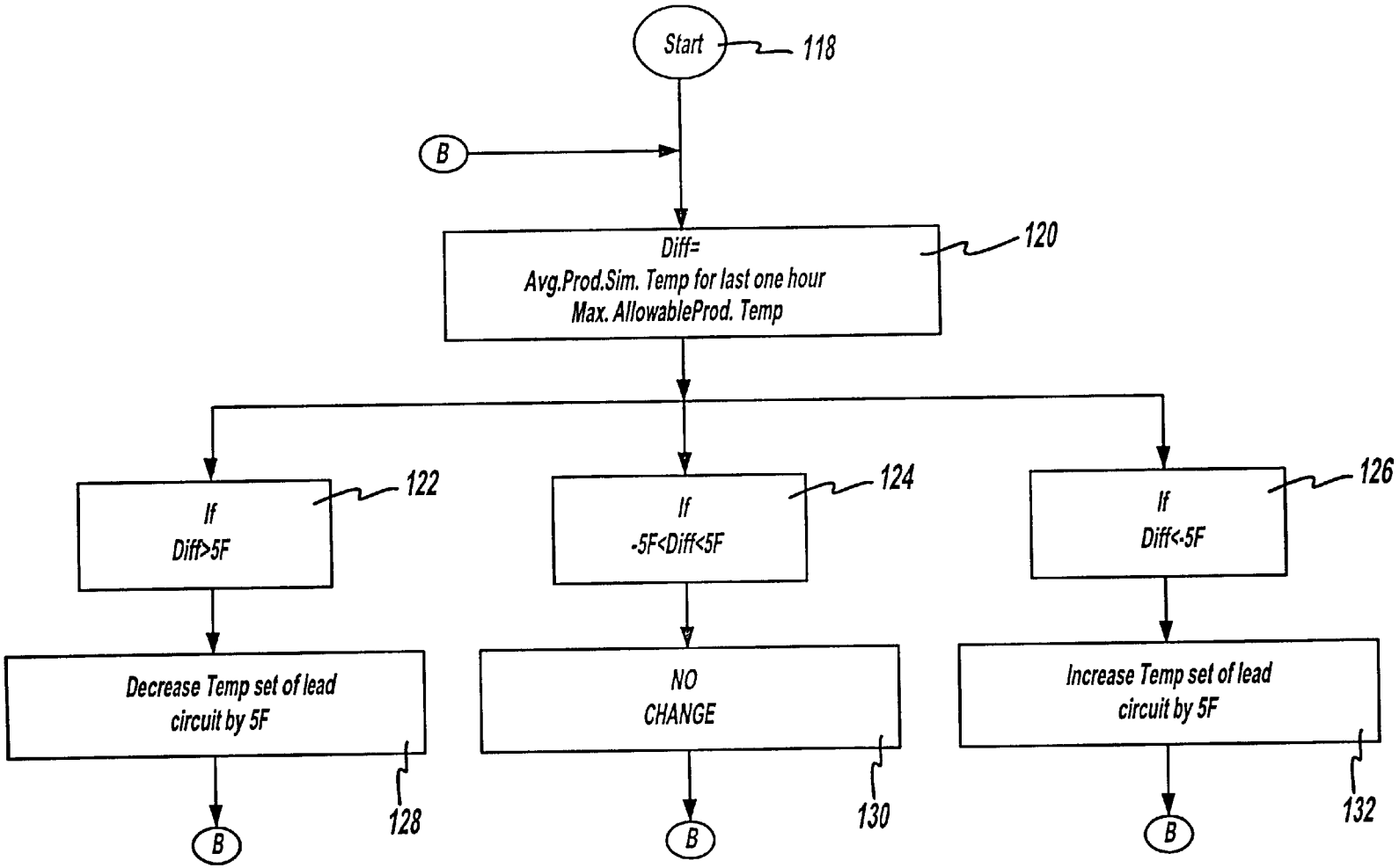
FIG. 8 is a flow chart illustrating floating circuit or case temperature control based upon a product simulator temperature probe.

Referring now to FIG. 8, a floating circuit temperature control logic 116 is illustrated. The floating circuit temperature control logic 116 is based upon taking temperature measurements from the product probe 50 shown in FIG. 2 which simulates the product temperature for the particular product in the particular circuit 26 being monitored. The floating circuit temperature control logic 116 begins at start block 118. From start block 118, the control logic proceeds to differential block 120. In differential block 120, the average product simulation temperature for the past one hour or other appropriate time period is subtracted from a maximum allowable product temperature to determine a difference (diff). In this regard, measurements from the product probe 50 are preferably taken, for example, every ten seconds with a running average taken over a certain time period, such as one hour. The maximum allowable product temperature is generally controlled by the type of product being stored in the particular refrigeration case 22. For example, for meat products, a limit of 41° F. is generally the maximum allowable temperature for maintaining meat in a refrigeration case 22. To provide a further buffer, the maximum allowable product temperature can be set 5° F. lower than this maximum (i.e., 36° for meat).

From differential block 120, the control logic 116 proceeds to either determination block 122, determination block 124 or determination block 126. In determination block 122, if the difference between the average product simulator temperature and the maximum allowable product temperature from differential block 120 is greater than 5° F., a decrease of the temperature set point for the particular circuit 26 by 5° F. is performed at change block 128. From here, the control logic returns to start block 118. This branch identifies that the average product temperature is too warm, and therefore, needs to be cooled down. At determination block 124, if the difference is greater than −5° F. and less than 5° F., this indicates that the average product temperature is sufficiently near the maximum allowable product temperature and no change of the temperature set point is performed in block 130. Should the difference be less than −5° F. as determined in determination block 126, an increase in the temperature set point of the circuit by 5° F. is performed in block 132.

By floating the circuit temperature for the entire circuit 26 or the particular case 22 based upon the simulated product temperature, the refrigeration case 22 may be run in a more efficient manner since the control criteria is determined based upon the product temperature and not the case temperature which is a more accurate indication of desired temperatures. It should further be noted that while a differential of 5° F. has been identified in the control logic 116, those skilled in the art would recognize that a higher or a lower temperature differential, may be utilized to provide even further fine tuning and all that is required is a high and low temperature differential limit to float the circuit temperature. It should further be noted that by using the floating circuit temperature control logic 116 in combination with the floating suction pressure control logic 80 further energy efficiencies can be realized.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for refrigeration system control, said method comprising:

identifying a lead circuit having a lowest temperature set point from a plurality of circuits;

initializing a suction pressure set point for a compressor rack having at least one compressor based upon the identified lead circuit;

determining a change in suction pressure set point based upon a measured parameter; and updating the suction pressure set point based upon the change in suction pressure set point until a first electronic evaporator pressure regulator for the lead circuit is approximately 100 percent open.

2. The method as defined in claim 1 wherein the plurality of circuits includes a first circuit and a second circuit, the first circuit being the lead circuit and further comprising determining suction pressure set point for the second circuit based on the updated suction pressure set point.

3. The method as defined in claim 2 further comprising determining a first parameter from the first circuit and determining a valve position for the first electronic evaporator pressure regulator based upon the first parameter.

4. The method as defined in claim 3 further comprising determining a valve position for a second electronic evaporator pressure regulator for the second circuit.

5. The method as defined in claim 4 further comprising determining a second parameter from the second circuit, wherein determining the valve position for the second electronic evaporator pressure regulator is based on the second parameter.

6. The method as defined in claim 1 further comprising determining if the lead circuit is in defrost.

7. The method as defined in claim 6 further comprising identifying a new lead circuit if the lead circuit is in defrost.

8. The method as defined in claim 7 wherein the new lead circuit is the circuit having the next lowest temperature set point from the plurality of circuits.

9. The method as defined in claim 7 further comprising initializing a new suction pressure set point for the compressor rack based upon a measured parameter for the new lead circuit.

10. The method as defined in claim 1 wherein initializing the suction pressure set point is based upon the saturation pressure of the lead circuit set point.

11. The method as defined in claim 1 wherein determining the change in suction pressure set point further includes using fuzzy logic to determine the change in the suction pressure set point.

12. The method as defined in claim 1 wherein the measured parameter is a product simulation temperature.

13. The method as defined in claim 1 wherein the measured parameter is a level of liquid sub-cooling after a condenser.

14. The method as defined in claim 1 wherein the measured parameter is relative humidity.

15. The method as defined in claim 1 wherein the measured parameter is a case temperature.

16. The method as defined in claim 1 wherein the measured parameter is a plurality of case temperatures.

* * * * *